US011219282B2

(12) United States Patent
Cao et al.

(10) Patent No.: US 11,219,282 B2
(45) Date of Patent: Jan. 11, 2022

(54) LOCKING DEVICE

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Yan-Lei Cao, Zhengzhou (CN); Luo Gong, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/993,357

(22) Filed: Aug. 14, 2020

(65) Prior Publication Data

US 2021/0361034 A1 Nov. 25, 2021

(30) Foreign Application Priority Data

May 22, 2020 (CN) ..... 202020877841.1

(51) Int. Cl.
*A44B 13/00* (2006.01)

(52) U.S. Cl.
CPC ..... *A44B 13/0052* (2013.01)

(58) Field of Classification Search
CPC ..... A44B 13/0052
See application file for complete search history.

(56) References Cited

U.S. PATENT DOCUMENTS 867,162 A * 9/1907 Seidl ..... A44C 5/22 24/574.1
2,674,774 A * 4/1954 Modrey ..... F16G 15/04 24/613
3,345,710 A * 10/1967 Bush ..... F16G 11/10 24/573.11
4,622,726 A * 11/1986 Nakamura ..... A44C 5/2057 24/303
4,679,959 A * 7/1987 Cavallaro ..... F16B 7/20 24/573.11
7,762,739 B2 * 7/2010 Blanchard ..... A01B 59/002 403/322.2
8,955,828 B2 * 2/2015 Campbell ..... H01R 13/625 256/10
2010/0011547 A1 * 1/2010 Schluep ..... F16B 45/04 24/599.9

* cited by examiner

*Primary Examiner* — David M Upchurch
(74) *Attorney, Agent, or Firm* — ScienBiziP, P.C.

(57) ABSTRACT

A locking device includes a sleeve, a locking assembly, and a stopper. The sleeve defines a locking cavity and stopping holes. The locking assembly includes a locking member received in the locking cavity and is rotatable relative to the sleeve to lock a hanging member in the sleeve or release the hanging member from the sleeve. The stopper and the stopping holes cooperate to position the locking member relative to the sleeve.

14 Claims, 5 Drawing Sheets

LOCKING DEVICE

FIELD

The subject matter herein generally relates to a locking device for locking and unlocking a hanging member.

BACKGROUND

Smart wearable devices are becoming more and more popular. For example, smart watches, bracelets, necklaces, and other products may require a lanyard for wearing on a body part. However, the existing lanyard connection is inconvenient for the operation and replacement of smart wearable devices, and a hanging object is prone to fall off the lanyard.

BRIEF DESCRIPTION OF THE DRAWINGS

Implementations of the present disclosure will now be described, by way of embodiments, with reference to the attached figures.

DETAILED DESCRIPTION

Figure 1:
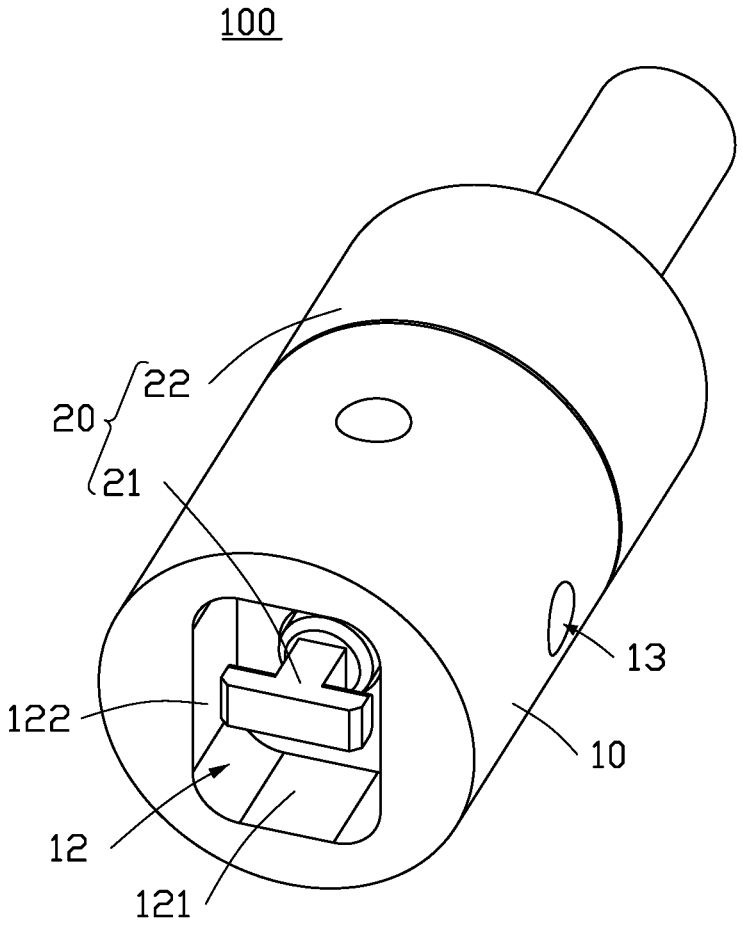
FIG. 1 is a perspective schematic diagram of a locking device according to an embodiment in a locked state.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale, and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder but can have one or more deviations from a true cylinder. The term "comprising" means "including, but not necessarily limited to"; it specifically indicates open-ended inclusion or membership in a so-described combination, group, series, and the like.

Figure 2:
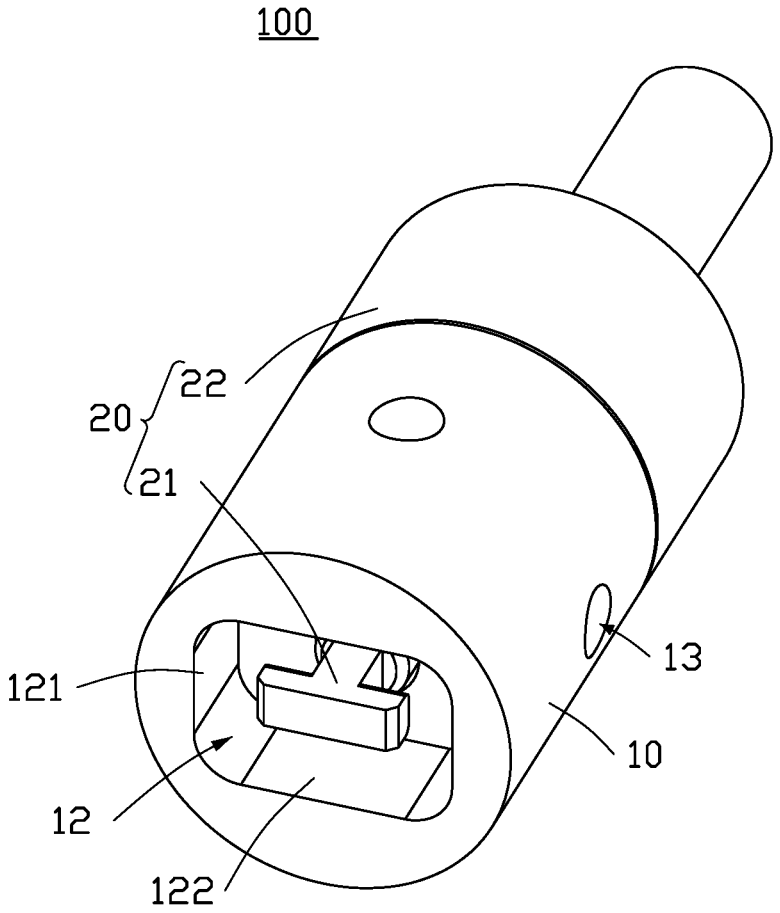
FIG. 2 is a perspective schematic diagram of the locking device shown in FIG. 1 in an unlocked state.
Figure 3:
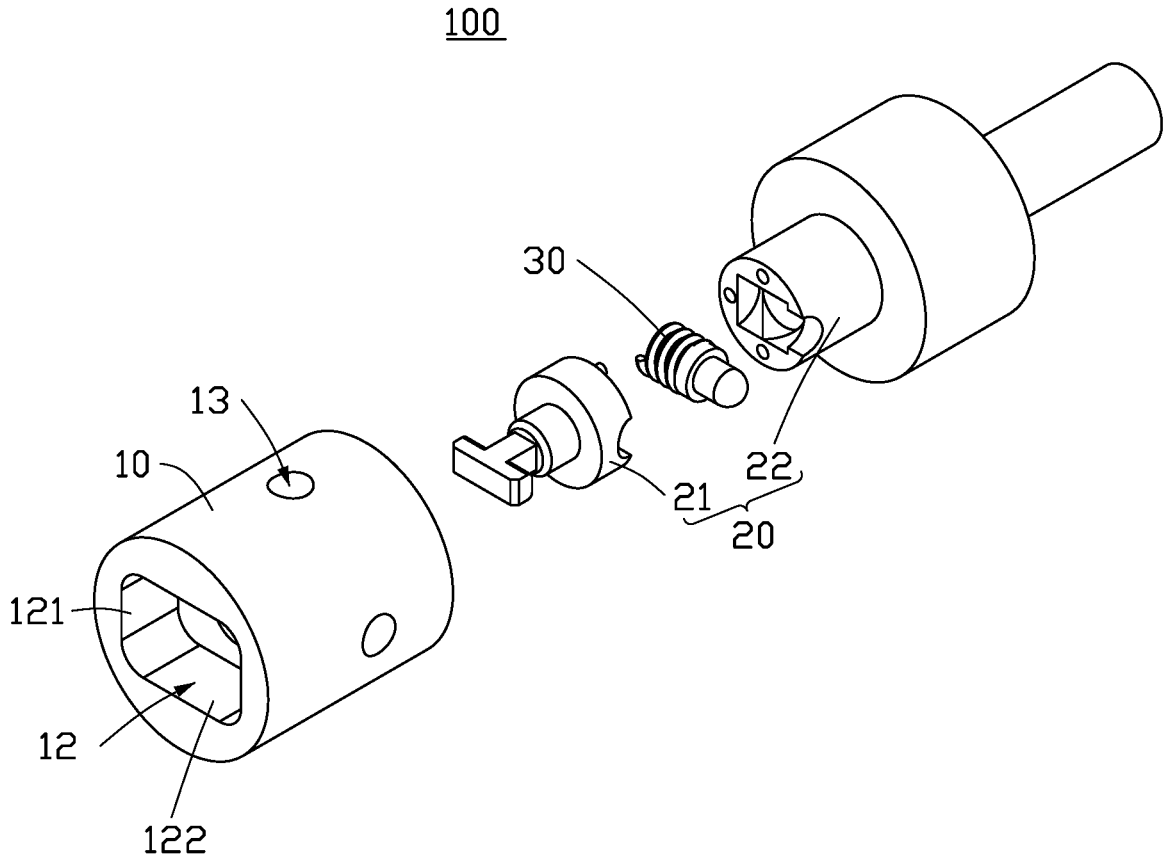
FIG. 3 is an exploded view of the locking device shown in FIG. 1.

Please refer to FIGS. 1, 2, and 3, an embodiment of a locking device 100 includes a sleeve 10, a locking assembly 20, and a stopper 30. The locking assembly 20 is arranged in the sleeve 10 and is used to lock a hanging member 200 in the sleeve 10. The stopper 30 is provided on the locking assembly 20 for fixing the locking assembly 20 in the sleeve 10. The sleeve 10 defines a receiving cavity 11 and a locking cavity 12. The receiving cavity 11 is in communication with the locking cavity 12. A plurality of stopping holes 13 is defined in a side wall of the sleeve 10 communicating with the receiving cavity 11, and the locking assembly 20 is received in the receiving cavity 11 and the locking cavity 12. A distance between the locking assembly 20 in the locking cavity 12 and a first inner wall 121 of the locking cavity 12 is greater than a distance between the locking assembly 20 in the locking cavity 12 and a second inner wall 122 of the locking cavity 12. The sleeve 10 is rotated to cause the stopper 30 to switch between the plurality of stopping holes 13.

When the sleeve 10 is rotated until the first inner wall 121 corresponds to the locking assembly 20, there is a large gap between the first inner wall 121 and the locking assembly 20 for disassembling the hanging member 200. It should be noted that the stopping holes 13 can be replaced with other structures in other embodiments for positioning the stopper 30 to prevent the locking assembly 20 from rotating relative to the sleeve 10.

When the sleeve 10 is rotated until the second inner wall 122 corresponds to the locking assembly 20, there is a small gap between the second inner wall 122 and the locking assembly 20 for locking the hanging member 200 in the sleeve 10.

Figure 4:
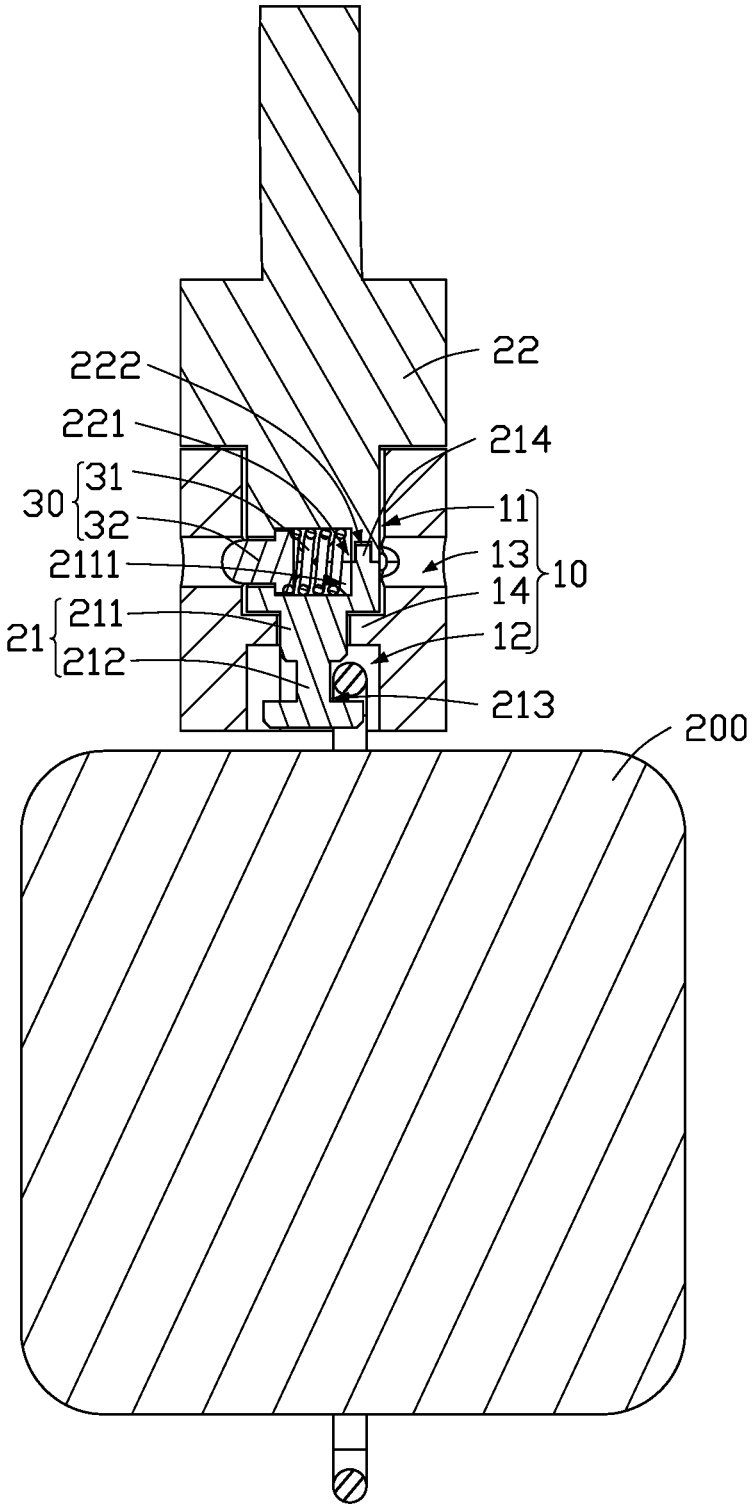
FIG. 4 is a cross-sectional view of the locking device shown in FIG. 1.

Referring to FIG. 4, a locking cavity 12 is located under the receiving cavity 11 and communicates with the receiving cavity 11. The plurality of stopping holes 13 is defined in a peripheral wall of the sleeve 10 in communication with the receiving cavity 11.

The receiving cavity 11 is substantially a cylindrical cavity for receiving a part of the locking assembly 20. It can be understood that the shape of the receiving cavity 11 matches an outer contour of the locking assembly 20. In other embodiments, the shape of the receiving cavity 11 changes as the outer contour of the locking assembly 20 changes.

The locking cavity 12 is substantially rectangular cuboid. A portion of the locking assembly 20 is received in the receiving cavity 11 and the locking cavity 12. The locking cavity 12 is provided with the first inner wall 121 and the second inner wall 122. The first inner wall 121 and the second inner wall 122 are perpendicular to each other, and the distance between the locking assembly 20 and the first inner wall 121 is greater than the distance between the locking assembly 20 and the second inner wall 122.

Further, when the sleeve 10 is rotated, when the first inner wall 121 corresponds to the locking assembly 20, there is a large gap between the first inner wall 121 and the locking assembly 20 through which the hanging member 200 can be detached and assembled. When the second inner wall 122 corresponds to the locking assembly 20, there is a small gap between the second inner wall 122 and the locking assembly 20, so that the second inner wall 122 and the locking assembly 20 lock the hanging member 200 in the sleeve 10.

The plurality of stopping holes 13 is arranged at equal intervals on the sleeve 10 so that when the sleeve 10 rotates a specified angle, the stopper 30 is clamped in the corresponding stopping hole 13 to fix the locking assembly 20 and maintain a relative position of the locking assembly 20 to the first inner wall 121 and the second inner wall 122, thereby preventing the hanging member 200 from falling off due to the rotation of the sleeve 10 caused by the shaking of the hanging member 200.

In one embodiment, the number of the stopping holes 13 is four. Four stopping holes 13 are arranged on the inner wall of the sleeve 10 at equal intervals. Two stopping holes 13 correspond to the first inner wall 121, and the other two stopping holes 13 correspond to the second inner wall 122.

It can be understood that the number of stopping holes 13 is not limited to four, and the specific number can be determined according to the angle to be rotated. As in other embodiments, the number of stopping holes 13 may be two. In addition, the shapes of the stopping holes 13 and the stopper 30 are adapted to each other.

The sleeve 10 further includes a supporting portion 14 located between the receiving cavity 11 and the locking cavity 12. The supporting portion 14 protrudes a predetermined distance from the inner wall of the sleeve 10 toward the center of the sleeve 10 to support the locking assembly 20 and prevent the hanging member 200 from pulling the locking assembly 20 away from the sleeve 10 under the action of gravity.

Referring to FIGS. 3 and 4, the locking assembly 20 includes a locking member 21 and a connecting member 22. The locking member 21 is received in the receiving cavity 11 and the locking cavity 12. One end of the connecting member 22 extends into the receiving cavity 11 and is connected to the locking member 21, and the other end of the connecting member 22 extends out of the sleeve 10.

Specifically, the locking member 21 includes a connecting portion 211 and a hook portion 212. The connecting portion 211 is received in the receiving cavity 11, and the locking member 21 is connected to the connecting member 22 through the connecting portion 211. The hook portion 212 is received in the locking cavity 12 and is used to lock the hanging member 200.

In one embodiment, the connecting portion 211 is substantially cylindrical and is adapted to the end of the connecting member 22. The connecting portion 211 defines a first mounting groove 2111 for mounting the stopper 30.

In one embodiment, the hook portion 212 is used to hook the hanging member 200. The hook portion 212 and an inner wall of the locking cavity 12 cooperatively define a receiving space 213, and the hanging member 200 is hung in the receiving space 213. When the sleeve 10 is rotated and the second inner wall 122 corresponds to the hook portion 212, the gap between the second inner wall 122 and the hook portion 212 is smaller than the cross-sectional area of the hanging member 200, so that the hook portion 212 and the second inner wall 122 lock the hanging member 200 in the receiving space 213. It can be understood that the shape of the hook portion 212 is not limited to this, as long as the hook portion 212 can lock the hanging member 200 with the second inner wall 122. In one embodiment, the hook portion 212 is substantially inverted "T"-shaped.

In one embodiment, the locking member 21 and the connecting member 22 are detachably connected to facilitate disassembly, assembly, and replacement of the stopper 30. Further, the locking member 21 is provided with an insertion post 214, and the connecting member 22 defines an insertion hole 222 corresponding to the insertion post 214. When the stopper 30 needs to be disassembled and replaced, the connecting member 22 is pulled out from the locking member 21, and the insertion post 214 is separated from the insertion hole 222. It can be understood that the shape, number, and connection manner of the insertion post 214 and the insertion hole 222 are not limited to this. In other embodiments, the locking member 21 and the connecting member 22 can be integrally formed.

The connecting member 22 can rotate relative to the sleeve 10. When the sleeve 10 or the connecting member 22 rotates, the first inner wall 121 and the second inner wall 122 sequentially correspond to the hook portion 212.

In order to further install the stopper 30, the connecting member 22 defines a second mounting groove 221 at a joint between the connecting member 22 and the connecting portion 211. The first mounting groove 2111 and the second mounting groove 221 are used for receiving the stopper 30. It can be understood that the shapes of the first mounting groove 2111 and the second mounting groove 221 are adapted to the shape of the stopper 30.

Referring to FIGS. 3 and 4, when the sleeve 10 rotates, in order to switch the stopper 30 between the plurality of stopping holes 13, the stopper 30 includes a resilient member 31 and a stopping block 32. Two ends of the resilient member 31 are respectively arranged on the inner wall of the second mounting groove 221 and the stopping block 32. The resilient member 31 provides a restoring force to the stopping block 32 so that the stopping block 32 can move in the second mounting groove 221.

Further, when the sleeve 10 rotates, the stopping block 32 separates from the stopping hole 13 and retracts along a compression direction of the resilient member 31 under the pressure of the inner wall of the sleeve 10 until the stopping block 32 aligns with the next stopping hole 13. At this time, the stopping block 32 restores under the elastic force of the resilient member 31 and resists in the next stopping hole 13.

It can be understood that the number of the resilient member 31 and the stopping block 32 is not limited to this. In other embodiments, the stopper includes two stopping blocks 32. A middle part of the resilient member 31 is fixed in the second mounting groove 221, and two ends of the resilient member 31 are respectively provided on the two stopping blocks 32. The stopping blocks 32 extend out of the second mounting groove 221 and resist in the corresponding stopping holes 13. When the sleeve 10 rotates, the two stopping blocks 32 switch between the corresponding stopping holes 13. The shape of the stopping blocks 32 matches the shape of the second mounting groove 221 and the stopping holes 13.

In one embodiment, the resilient member 31 may be a spring, a torsion spring, or the like.

In one embodiment, the hanging member 200 may be a smart watch, a bracelet, a necklace, or the like.

Referring to FIG. 4, in a locked state, the second inner wall 122 corresponds to the hook portion 212, and the hanging member 200 is hung in the receiving space 213 between the hook portion 212 and the second inner wall 122 to lock the hanging member 200 and the locking device 100.

Figure 5:
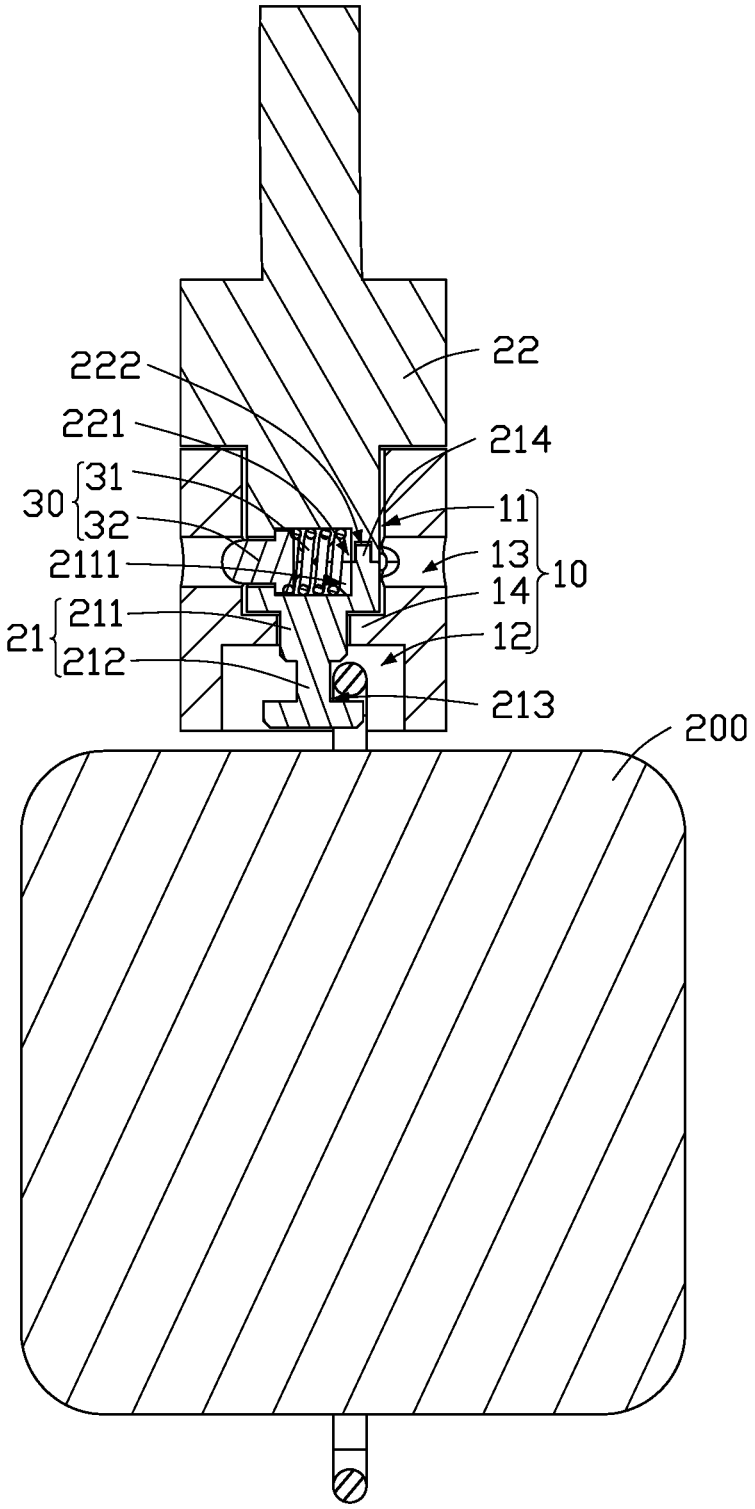
FIG. 5 is a cross-sectional view of the locking device shown in FIG. 2.

FIG. 5 shows an unlocked state of the locking device 100. The sleeve 10 is rotated relative to the stopping block 32. The stopping block 32 retracts inwardly along the compression direction of the resilient member 31 under the pressure of the inner wall of the sleeve 10 until the stopping block 32 aligns with the next stopping hole 13, and then the stopping block 32 restores under the elastic force of the resilient member 31 to resist in the next stopping hole 13. At this time, the first inner wall 121 corresponds to the hook portion 212, and there is a large gap between the first inner wall 121 and the hook portion 212, so the hanging member 200 can be taken out from the gap.

After the hanging member 200 is put into the gap and hung on the hook portion 212, the sleeve 10 is rotated until the stopping block 32 resists in the next stopping hole 13. At this time, the second inner wall 122 corresponds to the hook portion 212, and the hanging member 200 is locked in the receiving space 213 by the second inner wall 122 and the hook portion 212 to fix the hanging member 200.

In summary, the disassembly and assembly of the hanging member 200 is achieved by simply rotating the sleeve 10. In the locked state, the gap between the locking assembly 20 and the second inner wall 122 is smaller than the cross-sectional area of the hanging member 200, which prevents the hanging member 200 from falling off.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A locking device comprising:
a sleeve;
a locking assembly; and
a stopper; wherein:
the sleeve defines a locking cavity and a plurality of stopping holes;
the locking assembly comprises a locking member received in the locking cavity and rotatable relative to the sleeve to lock a hanging member in the sleeve or release the hanging member from the sleeve; and
the stopper and the plurality of stopping holes cooperate to position the locking member relative to the sleeve;
the locking assembly further comprises a connecting member coupled to the locking member and extending out of the sleeve; and
the stopper is located at a joint between the connecting member and the locking member.

2. The locking device of claim 1, wherein:
a distance between a first inner wall of the locking cavity and the locking member is larger than a distance between a second inner wall of the locking cavity and the locking member.

3. The locking device of claim 1, wherein:
the locking member comprises a connecting portion and a hook portion coupled to the connecting portion;
the hook portion is received in the locking cavity for locking the hanging member; and
the locking member is coupled to the connecting member through the connecting portion.

4. The locking device of claim 3, wherein:
the hook portion and the locking cavity cooperatively define a receiving space for receiving the hanging member.

5. The locking device of claim 1, wherein:
the locking member and the connecting member are detachably coupled.

6. The locking device of claim 1, wherein:
the locking member comprises an insertion post;
the connecting member defines an insertion hole corresponding to the insertion post; and
the insertion post is inserted in the insertion hole.

7. The locking device of claim 3, wherein:
a mounting groove is defined at the joint between the connecting portion and the connecting member; and
the stopper is received in the mounting groove.

8. The locking device of claim 7, wherein:
the stopper comprises a resilient member and a stopping block;
two ends of the resilient member are respectively arranged on an inner wall of the mounting groove and the stopping block;
the resilient member provides an elastic force for the stopping block to move the stopping block in the mounting groove.

9. The locking device of claim 1, wherein:
the sleeve further comprises a supporting portion protruding from an inner wall of the locking cavity.

10. A locking device comprising:
a sleeve;
a locking assembly; and
a stopper; wherein:
the sleeve defines a locking cavity and a plurality of stopping holes, the plurality of stopping holes arranged equidistantly in an inner wall of the locking cavity;
the locking assembly comprises a locking member received in the locking cavity and rotatable relative to the sleeve;
the stopper and the plurality of stopping holes cooperate to position the locking member relative to the sleeve;
a distance between a first inner wall of the locking cavity and the locking member is larger than a distance between a second inner wall of the locking cavity and the locking member;
in a locked state, the second inner wall and the locking member lock a hanging member in the sleeve; and
the sleeve is rotated relative to the locking member to switch between the locked state and an unlocked state.

11. The locking device of claim 10, wherein:
the locking assembly further comprises a connecting member coupled to the locking member and extending out of the sleeve; and
the stopper is located at a joint between the connecting member and the locking member.

12. The locking device of claim 11, wherein:
the locking member comprises a connecting portion and a hook portion coupled to the connecting portion;
the hook portion is received in the locking cavity for locking the hanging member; and
the locking member is coupled to the connecting member through the connecting portion.

13. The locking device of claim 12, wherein:
the hook portion and the locking cavity cooperatively define a receiving space for receiving the hanging member.

14. The locking device of claim 13, wherein:
in the locked state, the hanging member is hooked on the hook portion in the receiving space.

* * * * *